US009242163B2

(12) United States Patent
Kronzer

(10) Patent No.: US 9,242,163 B2
(45) Date of Patent: Jan. 26, 2016

(54) GOLF ALIGNMENT DEVICE

(71) Applicant: Corey Kronzer, Houston, TX (US)

(72) Inventor: Corey Kronzer, Houston, TX (US)

( * ) Notice: Subject to any disclaimer, the term of this patent is extended or adjusted under 35 U.S.C. 154(b) by 0 days.

(21) Appl. No.: 14/210,072

(22) Filed: Mar. 13, 2014

(65) Prior Publication Data

US 2014/0287850 A1 Sep. 25, 2014

Related U.S. Application Data

(60) Provisional application No. 61/780,539, filed on Mar. 13, 2013.

(51) Int. Cl.
*A63B 69/36* (2006.01)
*A63B 71/06* (2006.01)

(52) U.S. Cl.
CPC ..... *A63B 69/3667* (2013.01); *A63B 69/3623* (2013.01); *A63B 2071/0694* (2013.01); *A63B 2209/00* (2013.01); *A63B 2210/50* (2013.01); *A63B 2225/09* (2013.01)

(58) Field of Classification Search
USPC ..... 473/207, 208, 257, 266, 270, 272, 273, 473/277
See application file for complete search history.

(56) References Cited

U.S. PATENT DOCUMENTS

| | | | | |
|---|---|---|---|---|
| 2,169,407 | A * | 8/1939 | Crowley | 473/272 |
| 4,257,608 | A * | 3/1981 | Funk | 473/272 |
| 5,362,060 | A * | 11/1994 | Hinson | 473/218 |
| 5,435,727 | A * | 7/1995 | Dobson | 434/252 |
| 6,723,003 | B1 * | 4/2004 | Harrell | 473/270 |
| 7,922,598 | B1 * | 4/2011 | Karpyak et al. | 473/272 |
| 2003/0220151 | A1 * | 11/2003 | Bainter | 473/270 |
| 2006/0063603 | A1 * | 3/2006 | Bruschi | 473/270 |
| 2008/0015046 | A1 * | 1/2008 | Baggott | 473/272 |
| 2012/0264533 | A1 * | 10/2012 | Sasser | 473/208 |

* cited by examiner

*Primary Examiner* — Nini Legesse
(74) *Attorney, Agent, or Firm* — Patterson & Sheridan, LLP

(57) ABSTRACT

Embodiments of the invention include a golf alignment device that holds alignment rods at multiple positions to provide indicators for a golfer's target line, swing, and setup. The base piece has two arms on each end that hold an alignment rod parallel to the base piece, but with a gap between the two rods. These rods are pointed at the golfer's desired target, and this forms the target line. The base piece has multiple holes for a third alignment rod to be inserted. This third rod provides a golfer with a ball, clubface, and hand position indicator. A golfer uses the base piece to align their body up parallel with the target line.

7 Claims, 4 Drawing Sheets

GOLF ALIGNMENT DEVICE

CROSS-REFERENCE TO RELATED APPLICATIONS

This application claims benefit of U.S. provisional patent application Ser. No. 61/780,539, filed Mar. 13, 2013, which is herein incorporated by reference.

FIELD OF THE INVENTION

Embodiments of the invention relate to golf aids. More specifically, embodiments relate to golf alignment devices.

BACKGROUND OF THE INVENTION

One of the key fundamentals in the game of golf is being able to identify the target line. The target line is the imaginary line between the golf ball and the desired target. In a basic setup posture, a golfer's feet, knees, hips, and shoulders should be lined up parallel to this line. It is crucial that a golfer be able to visualize this line in order to achieve the proper setup. It is difficult to mark the target line and still hit a ball down it. Typical golf drills require an alignment rod to be placed parallel to or on the line at the golfer's feet. Placing the alignment rod parallel to the target line gives the golfer a good reference for what is parallel to the line, but it still forces the golfer to focus on a line that is not the target line. Placing the alignment rod on the line gives the golfer the visual of the actual target line, but it prohibits a golfer from hitting a ball on top of it. A golfer can mark a line on the ground and then hit ball off of it. Marking such a line is not suggested at most driving ranges due to the mess and the fact that some driving ranges use mats to hit balls off of. Further, if a golfer is able to mark a line it becomes difficult to make the line straight. Further, it becomes tedious to have to mark a new line every time the golfer changes their target line.

BRIEF SUMMARY OF THE INVENTION

Embodiments of the present invention include a portable, simple, and functional golf alignment device that holds multiple alignment rods at different angles to provide reference points for a golfer's target line, setup, and swing.

DETAILED DESCRIPTION

Figure 1:
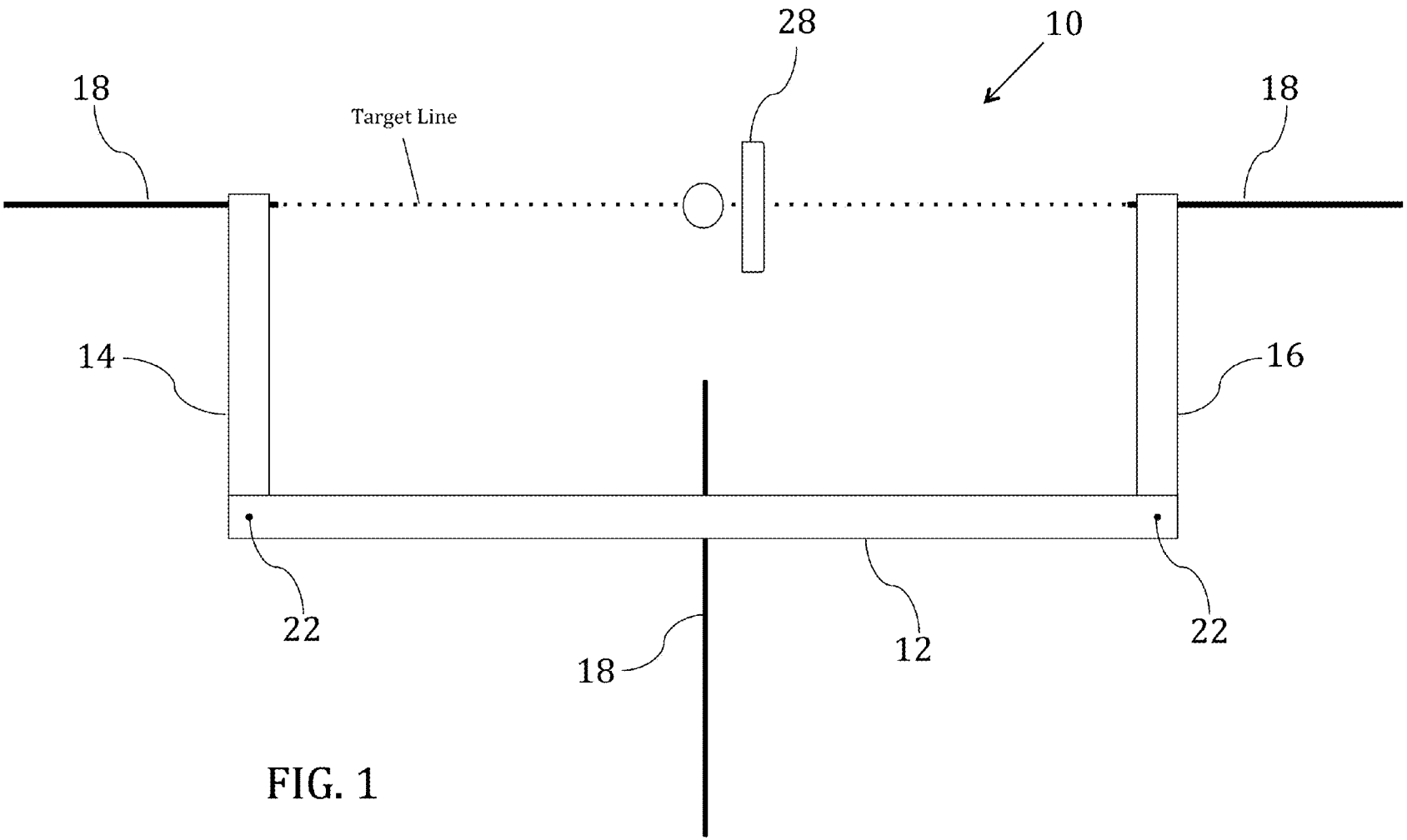
FIG. 1 is a top view of a golf alignment device.
Figure 2:
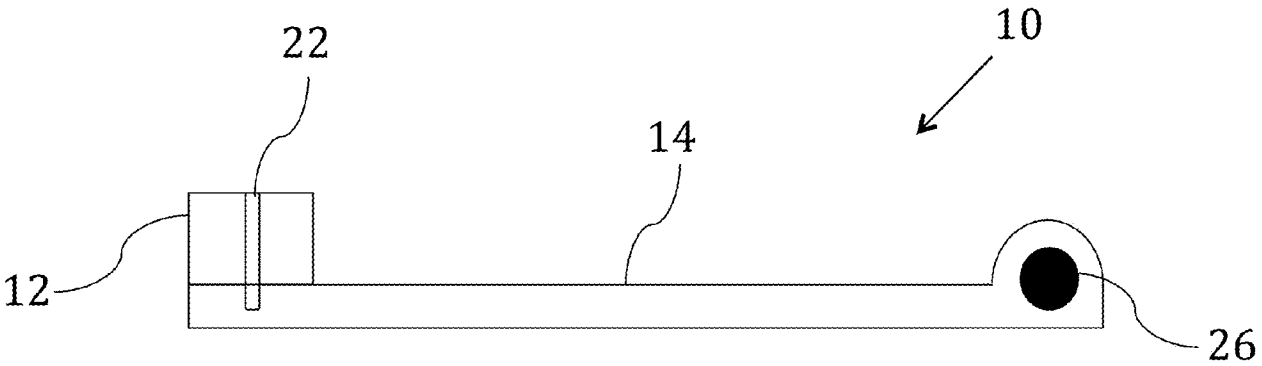
FIG. 2 is a side view of a golf alignment device of FIG. 1.

In FIGS. 1 and 2, a golf alignment device 10 is represented. The golf alignment device 10 is comprised of a base piece 12, a left arm 14 and a right arm 16. The left arm 14 is attached to the underside of the base piece 12 with a rotatable connection 22. The right arm 16 is attached in the same manner and location as the left arm 14 except on the opposite end of the base piece 12. The rotatable connection 22 is achieved with a screw. However, other embodiments have different ways of attaching the left arm 14 and right arm 16 to the base piece 12, such as a rivet or any other way that works in a manner consistent with this disclosure. A through hole 26 is located on the non-connected end of the left arm 14. The through hole 26 is sized to allow an alignment rod 18 to pass through it. The right arm 16 has the same through hole 26 located in the same manner as the left arm 14. Other embodiments have different ways of attaching an alignment rod 18 to the left arm 14 and right arm 16, such as a clip or any other way that works in a manner consistent with this disclosure. Other embodiments have ways of locking the left arm 14 and right arm 16 in opened and closed positions using stoppers or any other way that allows the left arm 14 and right arm 16 to be fixed in different positions.

The three alignment rods 18 can be of any length that fits the intended use of the disclosure. Readily available alignment rods are about 48 inches long. The diameter of the alignment rods is approximately 0.25 to 0.5 inches.

Figure 3:
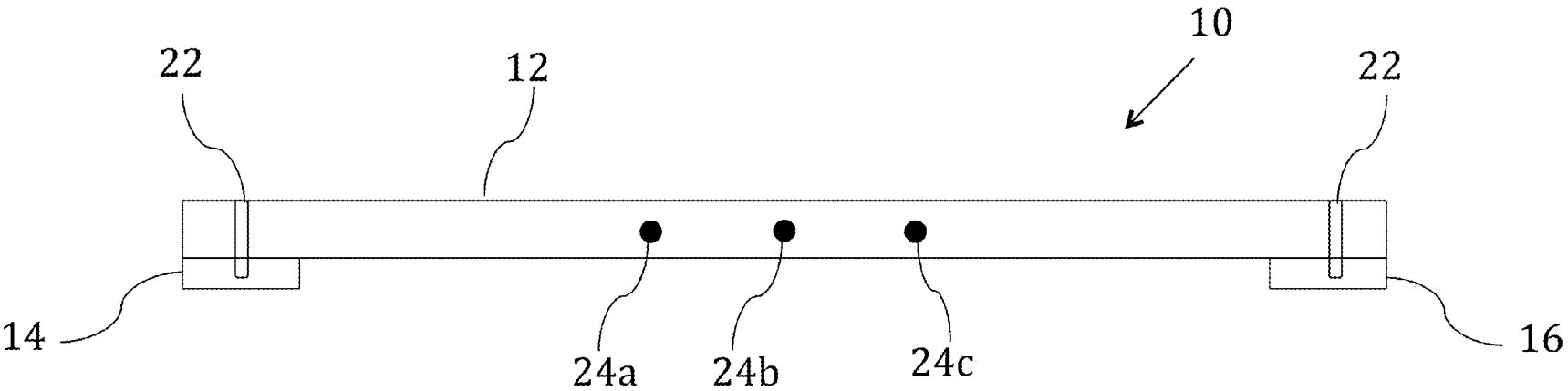
FIG. 3 is a back view of a golf alignment device of FIG. 1.

Referring to FIG. 3 At least one-through hole 24, in this case three, is provided in the base piece 12. The through holes 24 are sized to allow an alignment rod 18 to pass through the base piece 12 to extend in front and behind the base piece 12 and are disposed at spaced apart locations on the longitudinal axis of the base piece 12.

The base piece 12, left arm 14 and right arm 16 may be made of any suitable material such as a high-strength plastic or of any other sufficiently rigid and strong material. It is presently preferred that the base piece 12, left arm 14, and right arm 16 are made of a high strength plastic, or similar material, so that if a golfer accidently hits the base piece 12, left arm 14, or right arm 16, the likelihood of damage to his/her golf club and/or the alignment device 10 is reduced. The alignment rods 18 can be made of fiberglass or of any other sufficiently rigid and strong material.

In use, the left arm 14 is opened to form a 90-degree angle with the base piece 12, and the same is done for the right arm 16. An alignment rod 18 is inserted into the through-hole of the left arm 14 so that all but the alignment rod in the through-hole is extending to the left of the base piece 12. The same is done for the right arm 16, except the alignment rod 18 is extending to the right of the base piece 12. An alignment rod 18 is inserted into the desired hole 24 of the base piece 12 that fits the desired shot/club. The golfer then aligns the alignment device 10 that the alignment rods 18 in the left arm 14 and right arm 16 are aimed at the desired target. The visual formed by the alignment rods 18 in the left arm 14 and right arm 16 is the golfer's actual target line. The golfer then aligns the club 28 parallel to the alignment rod 18 that is inserted in the base piece 12. This ensures that the club 28 is square to the target line. The golfer then uses the base piece 12 to align his/her body parallel to the target line. The golfer then achieves what it feels like to be setup square to the target line, meaning their bodylines are parallel to the target line while their clubface is perpendicular to it. However, a golfer can alter their setup in relation to the target line to hit various shots.

Figures 4A, 4B, 4C:
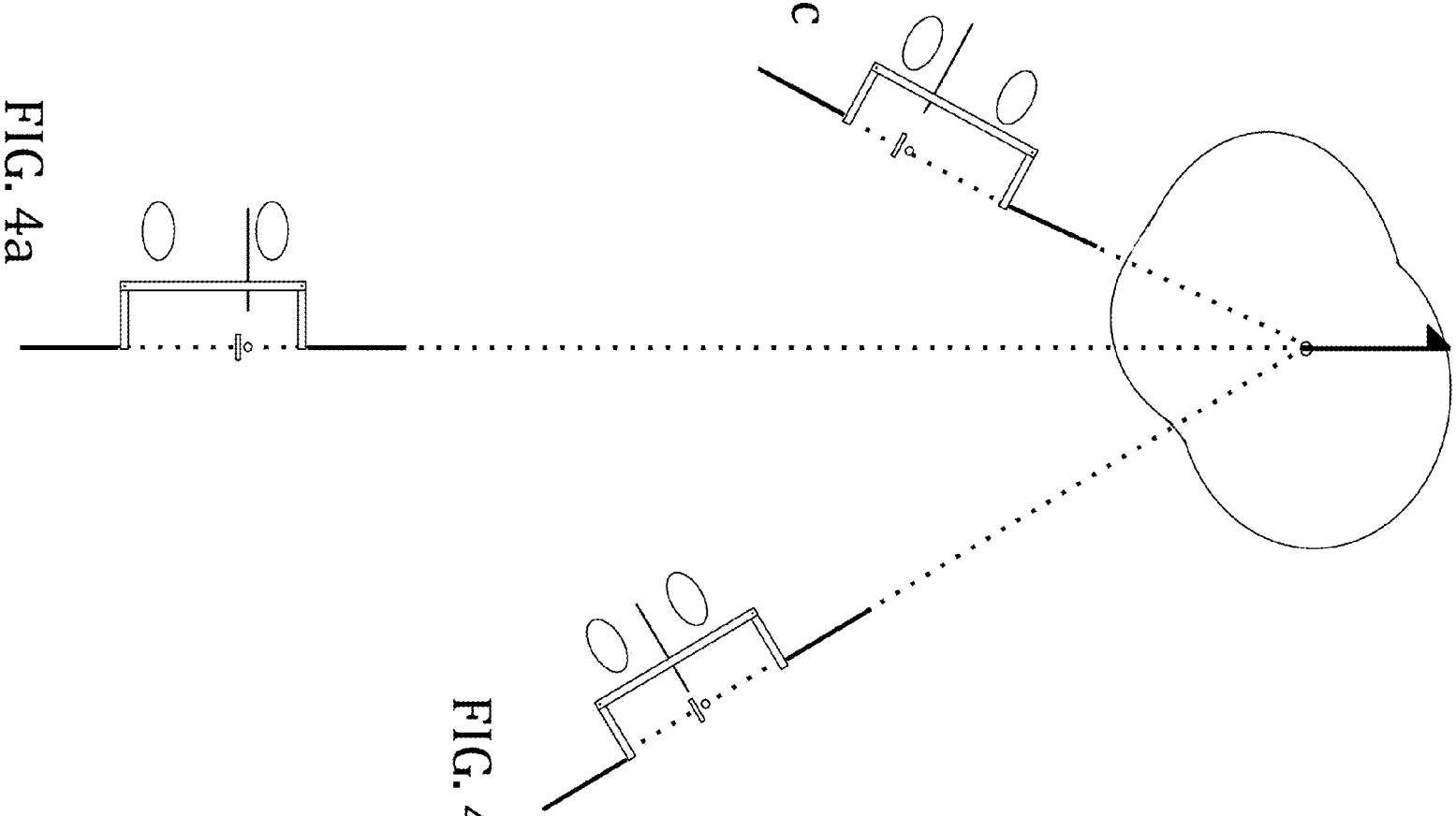
FIG. 4*a*-4*c* is a view of different setup positions of a golf alignment device of FIG. 1.

FIG. 4*a*-4*c* are different views of the alignment device 10 setup for use with different clubs.

Figure 6:
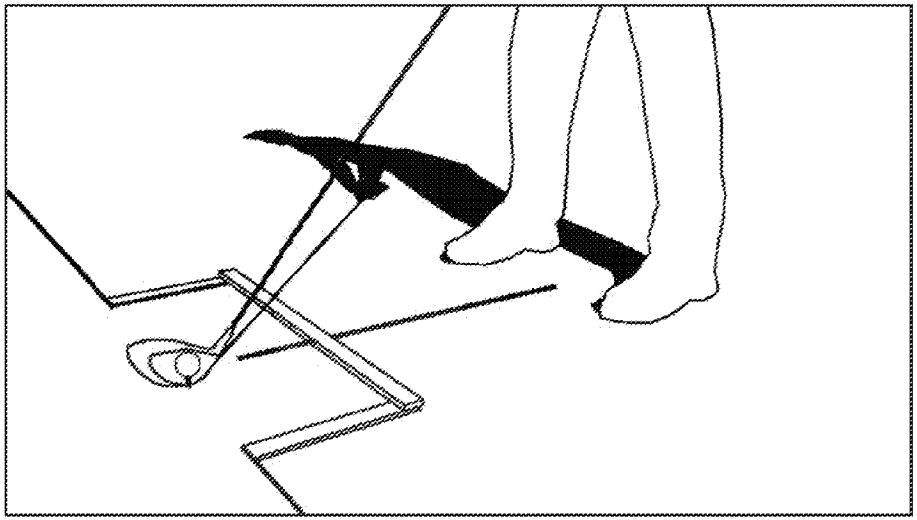
FIG. 6 is a close up photo of the golf alignment device of FIG. 1 being used by a golfer.
Figure 5:
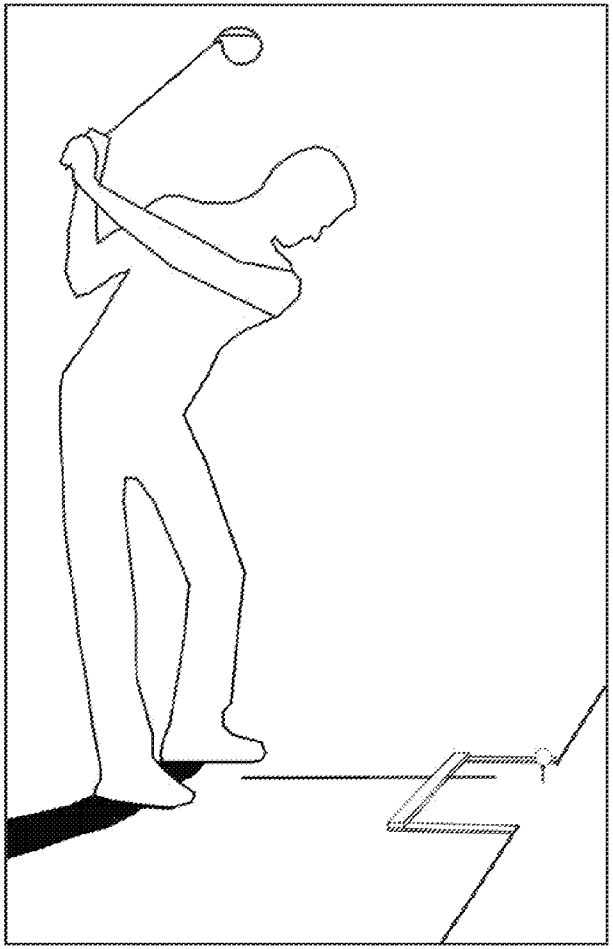
FIG. 5 is a photo of a golfer using a golf alignment device of FIG. 1.

FIG. 5-6 are perspective views of a right-handed golfer setup to/using the golf alignment device 10 with a driver. A left-handed golfer sets up the same way as a right-handed golfer except the through-hole 24 used is opposite. For example, a right-handed golfer could use the front through-hole 24*c* for a driver, while a left-handed golfer could use it for a wedge. However, a golfer can setup to use the alignment device 10 in any manner that suits the desired use of the present invention.

Broadly, embodiments of the invention relate to a golf alignment device that holds alignment rods to help visualize the target line and other various setup positions.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The invention claimed is:

1. A golf alignment device comprising:

a base having a first and a second end with at least one alignment rod attachment disposed between the first and second ends to attach an alignment rod orthogonal to a long axis of the base, the alignment rod attachment adapted to slidingly receive an attachment rod therethrough;

a first arm rotatably connected at a first end to the first end of the base and having at least one alignment rod attachment disposed at a second end thereof, the alignment rod attachment adapted to slidingly receive an attachment rod therethrough;

a second arm rotatably connected at a first end to the second end of the base and having at least one alignment rod attachment disposed at a second end thereof, the alignment rod attachment adapted to slidingly receive an attachment rod therethrough;

the first and second arms extendable to a position orthogonal to the base;

an alignment rod attached to the base at a position orthogonal to the long axis of the base;

an alignment rod attached to the first arm at a position orthogonal to a long axis of the first arm; and an alignment rod attached to the second arm at a position orthogonal to a long axis of the second arm; wherein the alignment rods of the first and second arms are aligned along a common axis.

2. The golf alignment device of claim 1, wherein the alignment rods attached to the first and second arms are positioned orthogonal to the alignment rod of the base.

3. The golf alignment device of claim 1, wherein the base, first arm and second arm are made of high-strength plastic.

4. The golf alignment device of claim 1, wherein the first and second arms can be locked in an open or closed position.

5. The golf alignment device of claim 1, wherein the arms are rotatably connected by a screw.

6. The golf alignment device of claim 1, wherein the arms are rotatably connected by a rivet.

7. The golf alignment device of claim 1, wherein the alignment rod attachments comprise holes for receiving the alignment rods therein.

* * * * *